United States Patent [19]

Nagy

[11] 4,451,038

[45] May 29, 1984

[54] TRANSPARENT SPHERE WITH MOVEABLE DIVIDERS AND PIECES

[76] Inventor: Bela A. Nagy, 854 Ranchero Drive, San Marcos, Calif. 92069

[21] Appl. No.: 377,692

[22] Filed: May 13, 1982

[51] Int. Cl.[3] ..... A63F 7/04

[52] U.S. Cl. ..... 273/110; 273/113; 273/128 R

[58] Field of Search ..... 273/109, 110, 111, 113, 273/115

[56] References Cited

U.S. PATENT DOCUMENTS

| | | | |
|---|---|---|---|
| 496,202 | 4/1893 | Leighton | 273/109 |
| 589,507 | 9/1897 | Mead | 273/111 |
| 716,697 | 12/1902 | Fraim | 273/113 |
| 3,743,292 | 7/1973 | Tracy | 273/113 X |

FOREIGN PATENT DOCUMENTS

| | | | |
|---|---|---|---|
| 1534096 | 7/1968 | France | 273/109 |

OTHER PUBLICATIONS

"Puzzle Ball", Sidney A. Tarrson Co., Mar. 10, 1965.

*Primary Examiner*—Richard C. Pinkham

*Assistant Examiner*—Scott L. Brown

*Attorney, Agent, or Firm*—John J. Murphey

[57] ABSTRACT

An amusement device composed of a transparent hollow sphere and rotatable transparent discs dividing it into two hemispheres. Each hemisphere is further divided into four compartments by transluscent wall segments moveable upon the discs.

A rotatable handle is further attached to the apex of the segments from outside the sphere which is able to rotate the compartments.

Each disc has a round opening to permit passage of a marble and another opening to permit passage of dice and rotates freely being activated by the dice being trapped between its opening and the moveable compartment wall.

The object of the invention is to tilt the sphere and align the openings in the discs by means of the dice so as to permit one to have single colored marble in a number of pre-identified compartments and dice in the pre-identified compartment after sorting the dice and marbles. Any number of marbles and dice can be in the groups as long as the groups are equal.

4 Claims, 10 Drawing Figures

TRANSPARENT SPHERE WITH MOVEABLE DIVIDERS AND PIECES

BACKGROUND OF THE INVENTION

1. Field of the Invention

This invention relates to amusement devices or puzzles and especially to transparent puzzles in the form of a crystal ball divided into multiples of four, five or six compartments or sections within the crystal ball.

2. Description of the Prior Art

There are many amusement devices in which there are a number of objects which must be moved into a number of compartments or receptacles. Only one of these devices is entirely transparent, U.S. Pat. No. 3,840,235 and that patent uses the relative invisibility of the transparent sections to restrict movement of the objects. The others, U.S. Pat. Nos. 3,979,840; 4,082,268, 3,488,052 and U.S. Pat. No. 3,785,651 have transparent portions but significant sections of the apparatus are colored or opaque.

Various devices are used in these inventions to halt the progress of balls into desired spaces. None of these devices are built similar to this device and depend as much upon the manual dexterity of the user.

OBJECT OF THE INVENTION

It is an object of this invention to divide twenty-one or more balls into seven groups of three or more like colored balls each in their own compartment of the crystal ball. The compartments may be pre-colored or marked.

It is another object of this invention to mix three or more dice with the twenty-one or more balls and have three or more dice grouped together in one of the premarked compartments.

It is another object of this invention to permit one or more balls to pass through the holes in the circular discs.

It is a further object of this invention to force the user of the crystal ball to rotate the ball and turn the handles to align the holes and permit like colored or shaped objects to be grouped.

It is a still further object of this invention to construct the dice so that they may enter the square hole from a flat side. Five sides are slightly rounded so they will have difficulty passing through the opening. This increases the difficulty of the puzzle.

It is still another object of this invention to permit balls to fall through the round holes when the square holes are aligned for the dice. This increase the difficulty of solving the puzzle.

It is still a further object of this invention to provide a transparent ball with translucent dividing sections so as to make the solution more difficult by forcing the user to move the entire ball to see marbles in remote sections.

SUMMARY OF THE INVENTION

One embodiment of the present invention is a puzzle comprising a hollow transparent sphere within which are two round discs one located on top of the other freely rotatable which divides the ball into two hemispheres. The discs each contain one round hole that permits a ball to pass through and another that is square and will only permit the dice to drop through. Four translucent sections divide the upper and lower hemisphere into equal compartments. The four upper sections are connected to a handle outside the crystal ball going through the apex of the four sections enabling the four chambers to rotate independent of the discs. The chambers in the bottom hemisphere are similarly arranged.

In the at rest task, accomplished or solution state, each of the compartments has three or more identical colored balls or three or more dice in them, according to the premarking of the sphere. This is accomplished by rolling or tilting the crystal ball until a colored ball passes through the holes into a compartment with other like colored balls or like shaped dice. The compartment having been pre-marked as to color and shape.

DESCRIPTION OF THE PREFERRED EMBODIMENT

Figure 1:
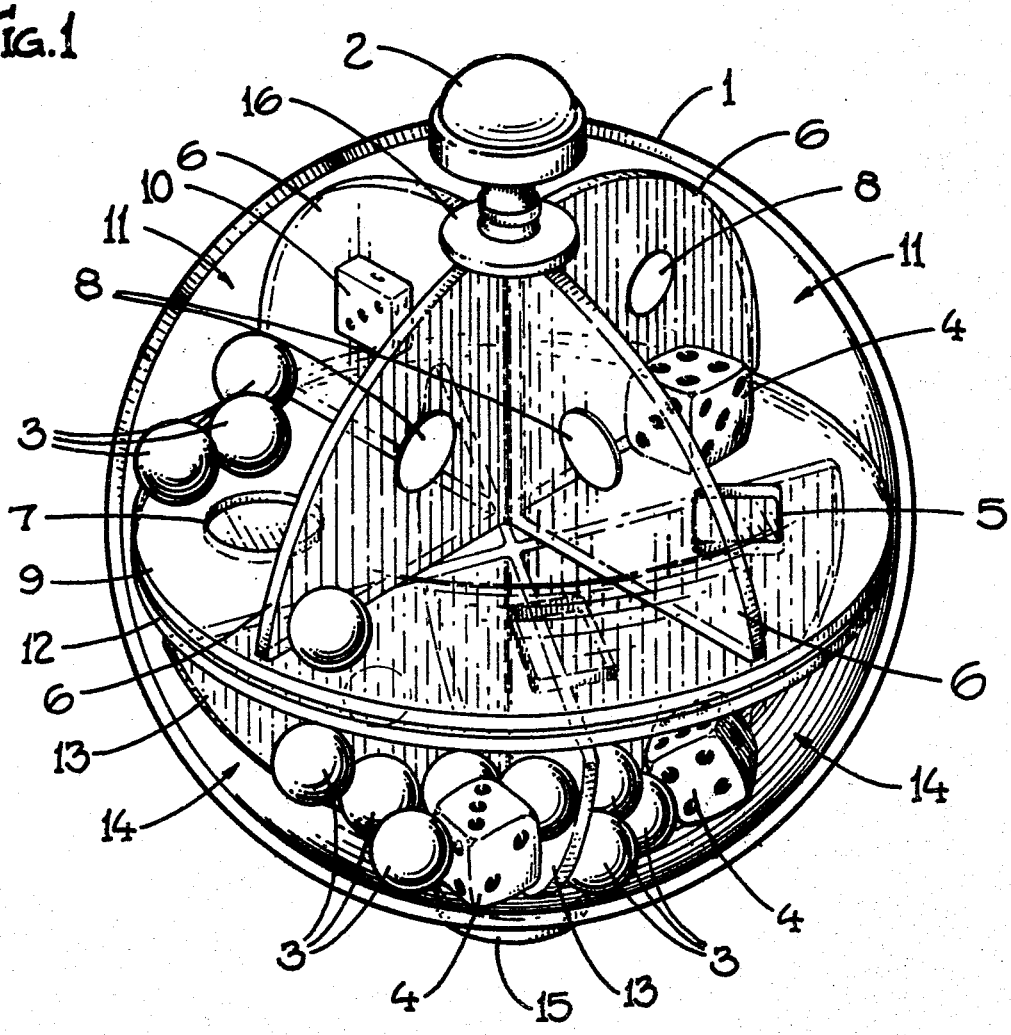
FIG. 1 is a perspective view of the puzzle of the present invention.

For the purpose of promoting an understanding of the principles of the invention, reference will now be made to the embodiments illustrated in the drawings.

Figure 2:
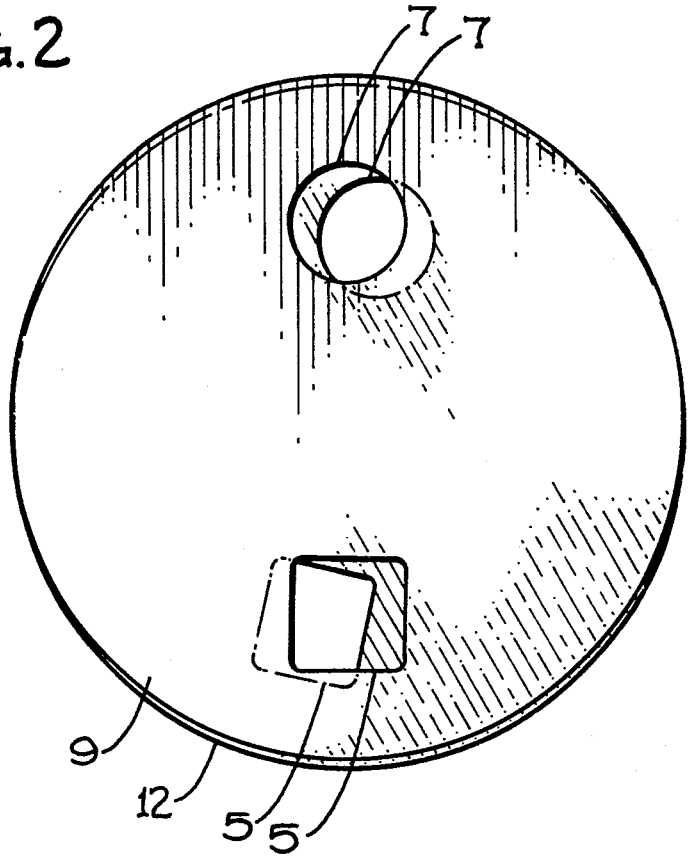
FIG. 2 is a top view of the inside discs.
Figure 3:
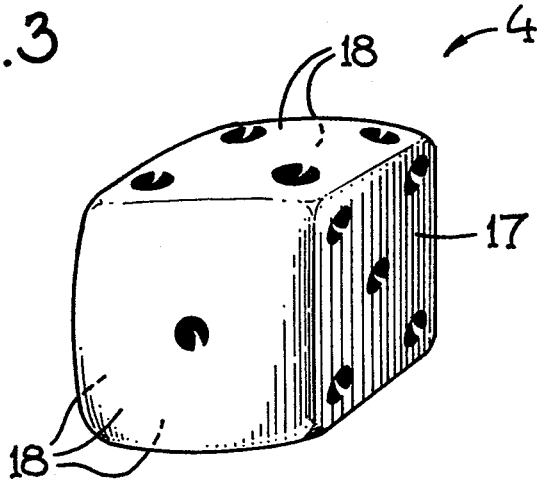
FIG. 3 is a perspective view of a die of the present invention.
Figure 4:
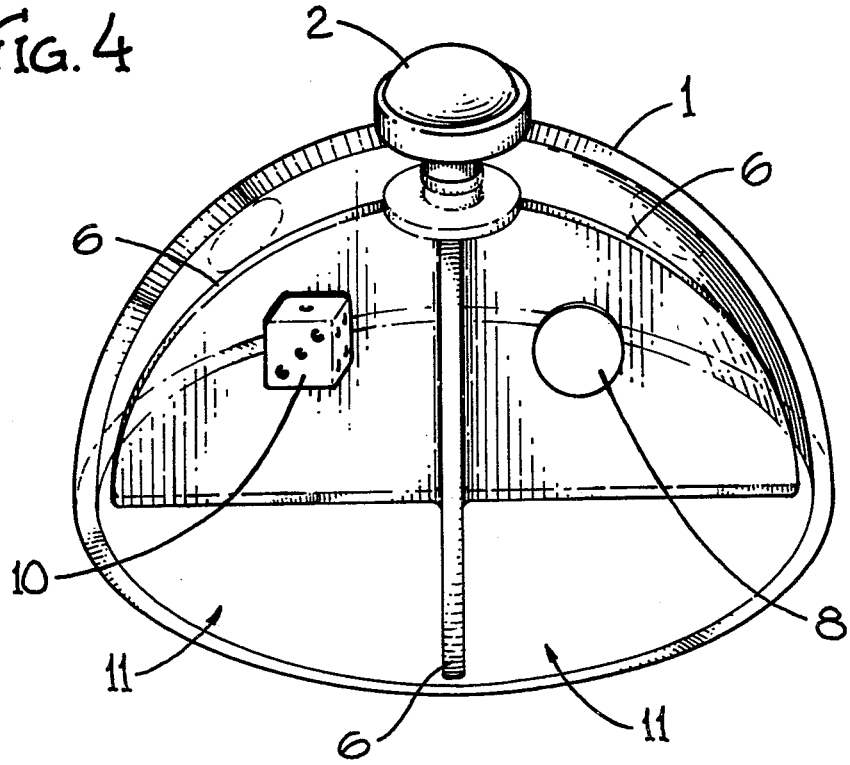
FIG. 4 is a top perspective view of the upper hemisphere of this invention.

Referring now particularly to FIG. 1 there is shown a puzzle comprised of a transparent plastic shell 1, passing through the shell 1 and attaching to four translucent quadrant segments 6, is a handle 2. Translucent quadrants and discs are used to increase the difficulty of seeing the marbles in remote sections making one move the sphere and perhaps have some marbles or dice fall into non-selected compartments. Within the shell compartments are a number of plastic balls 3 and a number of dice 4. Any number of marbles or dice, three, four or five in a group, may be used depending upon the size of the sphere as long as the groups are equal in size. Two transparent discs 9 and 12 one above the other divide the shell into a lower and upper hemisphere. Each disc 9 and 12 has a round opening 7 to allow passage of the balls 3 and a square opening 5 to allow passage of the dice 4. Each disc is freely rotatable and may be rotated to cover or align the openings. FIG. 2 illustrates these best. The quadrant sections 6 are fastened to the handle 2 at part 16 and transluscent compartments 11 rotate when handle 2 is rotated. The lower disc 12 is freely rotatable while the transluscent quadrant segments 13 and the compartments 14 rotate only when the bottom handle 15 is rotated. Different colored balls 8 are premarked on the inside of seven of the compartments of the transluscent sphere 1 corresponding to the final solution. One compartment is premarked with the outline of a die 10. The die 4 is manufactured with one flat face 17 and five rounded faces 18. These rounded faces 18 have edges slightly curved and will not pass easily through square opening 5 in the circular discs 9 and 12 but want to slip out of the opening 5. This increases the difficulty of solving the puzzle. FIG. 4 illustrates the upper hemisphere. When purchased the like colored balls 3 are in the corresponding premarked compartment and the die in the premarked dice compartment. The user then rotates the handles 2 and 15 and mixes the dice and balls in the lower compartments 14. By rotating the shell 1 and rotating the discs 9 and 12 by turning handles 2 and 15 with dice 4 partially in holes 5 the object is to sort the colored balls 3 and dice 4 into their respective compartments.

Still other modifications or other embodiments, necessitating the movement of colored marbles in a transparent sphere through various obstacles which do not depart from the theory of this invention may be devised. They will not depart from the essence or spirit of the invention which is cited in the following claims.

I claim:

1. An amusement device comprising in combination:

a transparent sphere;

two freely rotating transparent flat discs within the housing dividing the sphere into an upper hemisphere and a lower hemisphere with openings for marbles or dice;

two arcuate segments dividing each hemisphere into four compartments each identified by a printed or scribed colored ball or die;

seven groups of glass or plastic marbles each of a different color;

a group of dice only one surface of each which has sharp edges to assist in moving the dice through the square opening;

and, an upper and lower handle located outside the disc fastened to the segments so that they will rotate with the handles.

2. The device according to claim 1 in which the internal parts except the marbles and dice and discs are transluscent.

3. The device according to claim 2 in which the compartments are premarked with a color corresponding with a marble color or a die.

4. The device according to claim 1 in which the groups of glass or plastic marbles are three, four or five.

* * * * *